US007427461B2

(12) United States Patent
Nakamura et al.

(10) Patent No.: US 7,427,461 B2
(45) Date of Patent: Sep. 23, 2008

(54) TONER FOR DEVELOPING ELECTROSTATIC LATENT IMAGE, IMAGE FORMING APPARATUS AND IMAGE FORMING METHOD

(75) Inventors: Yasushige Nakamura, Ebina (JP); Satoshi Takezawa, Ueda (JP)

(73) Assignee: Fuji Xerox Co., Ltd., Tokyo (JP)

( * ) Notice: Subject to any disclaimer, the term of this patent is extended or adjusted under 35 U.S.C. 154(b) by 431 days.

(21) Appl. No.: 10/930,753

(22) Filed: Sep. 1, 2004

(65) Prior Publication Data

US 2005/0084785 A1 Apr. 21, 2005

(30) Foreign Application Priority Data

Sep. 11, 2003 (JP) ..... 2003-319567

(51) Int. Cl.
*G03G 9/00* (2006.01)

(52) U.S. Cl. ..... 430/108.21; 430/108.1; 430/109.4

(58) Field of Classification Search ..... 430/108.1, 430/108.2, 108.21, 109.4
See application file for complete search history.

(56) References Cited

U.S. PATENT DOCUMENTS

| | | | | |
|---|---|---|---|---|
| 3,345,293 | A | 10/1967 | Bartoszewicz et al. | |
| 4,312,932 | A | 1/1982 | Hauser et al. | |
| 4,777,105 | A | 10/1988 | Macholdt et al. | |
| 5,912,099 | A * | 6/1999 | Kanbayashi et al. | 430/108.21 |
| 6,251,553 | B1 * | 6/2001 | Baur et al. | 430/108.21 |
| 2002/0037466 | A1 * | 3/2002 | Kanbayashi et al. | 430/108.23 |
| 2003/0203304 | A1 * | 10/2003 | Katagiri et al. | 430/124 |

FOREIGN PATENT DOCUMENTS

| | | |
|---|---|---|
| JP | A 01-142559 | 6/1989 |
| JP | A 04-268571 | 9/1992 |
| JP | A 05-011504 | 1/1993 |
| JP | A 05-034980 | 2/1993 |
| JP | A 09-179348 | 7/1997 |
| JP | A 10-097102 | 4/1998 |
| JP | A-11-049998 | 2/1999 |
| JP | A 2002-156775 | 5/2002 |
| JP | A 2002-182422 | 6/2002 |
| JP | A 2003-162097 | 6/2003 |

* cited by examiner

*Primary Examiner*—Mark F. Huff
*Assistant Examiner*—Peter L Vajda
(74) *Attorney, Agent, or Firm*—Oliff & Berridge, PLC

(57) ABSTRACT

A toner for developing an electrostatic latent image, including toner particles that include at least a binder resin and a quinacridone pigment. The quinacridone pigment includes quinacridone represented by the following structural formula which has a β-type crystal structure and quinacridone represented by the following structural formula which has a γ-type crystal structure.

7 Claims, 4 Drawing Sheets

TONER FOR DEVELOPING ELECTROSTATIC LATENT IMAGE, IMAGE FORMING APPARATUS AND IMAGE FORMING METHOD

CROSS-REFERENCE TO RELATED APPLICATION

This application claims priority under 35USC 119 from Japanese Patent Application No. 2003-319567, the disclosure of which is incorporated by reference herein.

BACKGROUND OF THE INVENTION

1. Field of the Invention

The present invention relates to a toner for developing an electrostatic latent image applied to a developer used to develop an electrostatic latent image in electrophotography, electrostatic recording, electrostatic printing and the like, to an image forming method and an image forming apparatus using the toner.

2. Description of the Related Art

As to full-color images produced by an electrophotographic method, there has recently been an increasing demand for the development of high quality and highly precise full-color images. Full-color images produced by an electrophotographic method are not on a level satisfying general customers familiar with printed images. To satisfy this demand, studies are being made for bringing the level of such full-color images close to that of prints or photographs.

Also, along with recent ecological trends, not only toxicity tests typified by the AMES test and skin sensitivity tests for toners have been made, but studies concerning limitation of the addition of dioxin-generating materials such as halogens to toners have also been made. Moreover, as to dyes and pigments which are colorants contained in a toner, when strong light such as a xenon flash is used to carry out fixing, most dyes are sublimated and, in most pigments, a part of byproducts are sublimated and deteriorated by light. Thus, there are cases where the intended color reproducibility is not obtained.

For the above reason, it is urgently necessary to develop toners which (1) have a wide color range, (2) have high ecological properties, (3) have good light fastness, (4) do not allow colorants to be sublimated by intense light (high temperature) and (5) are relatively inexpensive.

Therefore, as colorants used for toners, those having high tinting strength, excellent color vividness and high light fastness, as well as high dispersibility in a resin, are strongly desired.

Although many pigments for magenta toners have been proposed so far, quinacridone type pigments are widely used due to the fact that they have excellent color vividness and transparency and are also superior in light fastness.

For example, a toner singly containing 2,9-dimethylquinacridone is disclosed (see, for example, Japanese Patent Application Laid-Open (JP-A) Nos. 49-27228, 57-54954 and 1-142559). However, this toner is not regarded as a sufficiently vivid magenta toner though it has high light fastness.

Also, attempts are made to blend Rhodamine dyes with various pigments (see, for example, JP-A Nos. 5-34980, 5-11504 and 4-268571). However, these toners cannot be used because the Rhodamine dye is sublimated when flash fusing is carried out. Although the Rhodamine dye is not sublimated when these toners are used for heat roll fixing, these toners have the problem that the Rhodamine dye is discolored within a few days when the toner is stored outdoors because the Rhodamine dye has low light fastness.

It has been proposed to use quinacridone type pigments (C.I. Pigment 122) and a carmine (C.I. Pigment Red 57:1) or to blend a naphthol type pigment (C.I. Pigment Red 184 or C.I. Pigment Red 238) with a C.I. Pigment Red 57:1 to improve color developing ability (see, for example, JP-A Nos. 9-179348 and 2003-162097). Although these proposals achieve a balance between cost and color reproducibility, the C.I. Pigment Red 57:1 pigment is decomposed when flash fusing is carried out, leading to deteriorated color tone and blackish prints. Also, when this toner is used for heat roll fixing, it has the problem that color blurring occurs when the toner is stored outdoors for a long period of time because the light fastness of the C.I. Pigment Red 57:1 is somewhat weak.

Moreover, a colorant has been proposed which is produced using 2,9-dimethylquinacridone and an unsubstituted quinacridone having the following structure as a magenta colorant, has the intended hue and is intended to improve the frictional electrification characteristics of a toner (see, for example, JP-A Nos. 62-291669 and 10-97102). Since an unsubstituted quinacridone is used in this case, it has strong light fastness and is resistant to deterioration in both the case of flash fusing and the case of heat roll fixing. However, it has been found that since quinacridones having different chemical structures are blended, the dispersibility of a pigment is impaired and color reducibility is slightly deteriorated in the case of general-purpose mixing without carrying out a so-called master batch process. Also, it is a matter of concern that 2,9-dimethylquinacridone is expensive.

This magenta toner may be used in the case of using a heat roll. However, it is known that, in contrast with a heat roll fixing system, a flash-fusing system enables ultra-high speed printing because contact with a medium is decreased in the flash-fusing system (see, for example, JP-A Nos. 2002-156775 and 2002-182422). Thus, there is a demand for a magenta toner in which the aforementioned problems have been solved and which is compatible not only with fixing using a heat roll, but with a fixing apparatus utilizing the above-described flash-fusing system.

SUMMARY OF THE INVENTION

The present invention has been made in view of the above-described circumstances and provides a toner for developing an electrostatic latent image which can be used as a magenta toner. The toner has a wide color range, highly ecological properties, and excellent light fastness, and is relatively inexpensive. The toner prevents a colorant from being sublimated by intense light (high temperature). In addition, it is possible to utilize a heat roll as a fixing member for this toner, and the toner is not deteriorated in color even when fixed by using intense light such as a flash. The present invention also provides a method of producing the toner, an image forming method using the toner, and an image forming apparatus using the toner.

A first invention is to provide a toner for developing an electrostatic latent image, comprising toner particles that comprise at least a binder resin and a quinacridone pigment. The quinacridone pigment comprises quinacridone represented by the following structural formula which has a β-type crystal structure and quinacridone represented by the following structural formula which has a γ-type crystal structure.

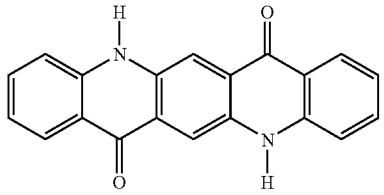

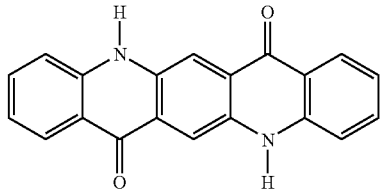

A second invention is to provide an image forming apparatus comprising: an electrostatic latent image forming unit for forming an electrostatic latent image on a surface of an electrostatic latent image holding member; a developing unit for developing the electrostatic latent image on the surface of the electrostatic latent image holding member by a developer including the toner of the first invention to form a toner image; a transferring unit for transferring the toner image to a surface of a recording material; and a fixing unit for fixing the toner image on the surface of the recording material.

A third invention is to provide an image forming method comprising: forming an electrostatic latent image on a surface of an electrostatic latent image holding member; developing the electrostatic latent image on the surface of the electrostatic latent image holding member by a developer including the toner of the first invention to form a toner image; transferring the toner image to a surface of a recording material; and fixing the toner image on the surface of the recording material.

The invention can provide a toner for developing an electrostatic latent image as a magenta toner (toner for developing an electrostatic latent image) which has a wide color range, highly ecological properties, good light fastness, prevents a colorant from being sublimated by intense light (high temperature) and is relative inexpensive, can use a heat roll as a fixing member and is not deteriorated in color in the case of fixing using intense light such as a flash, a method of producing the toner and an image forming method and an image forming apparatus using the toner.

DETAILED DESCRIPTION OF THE INVENTION

Figure 1:
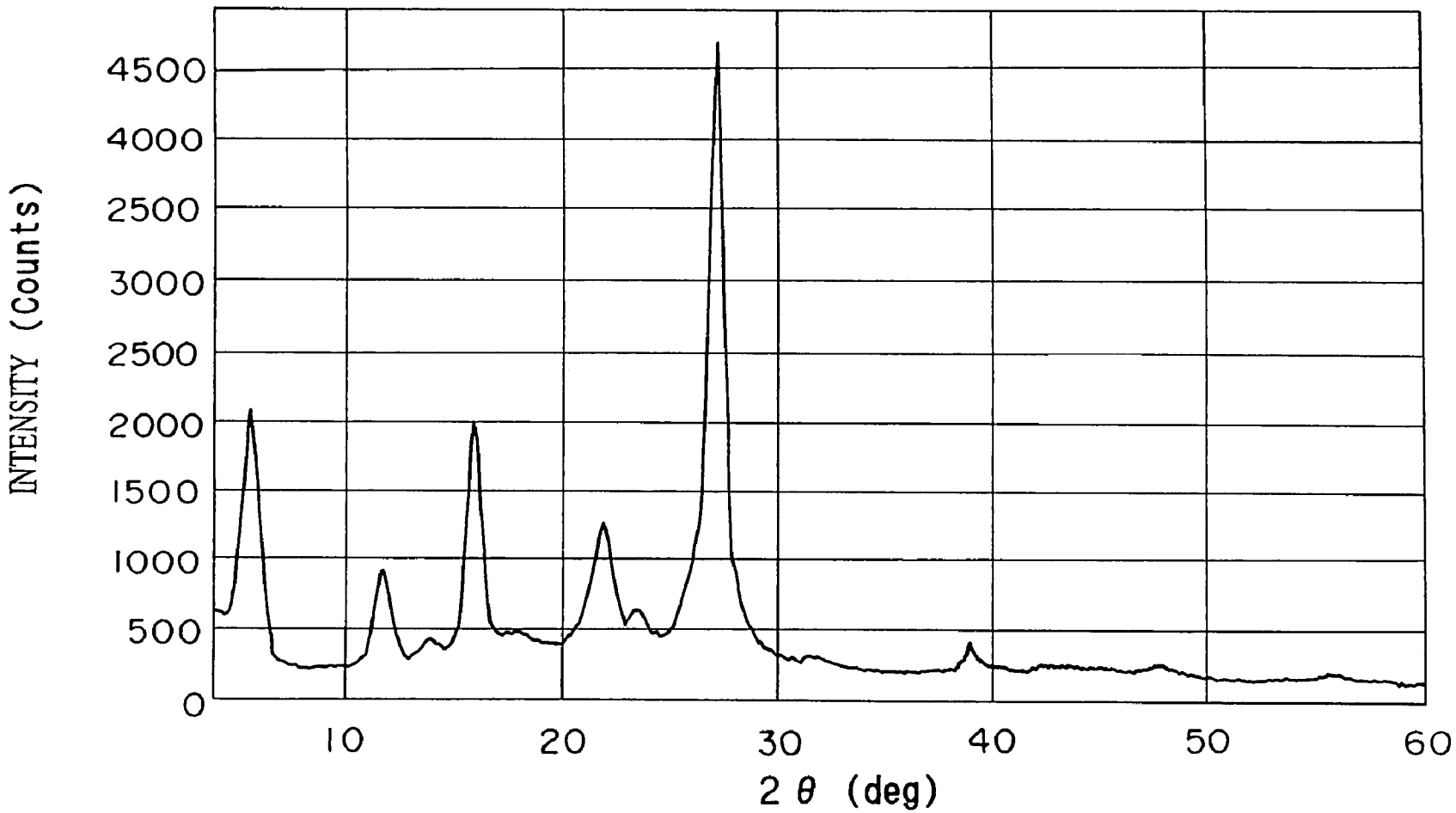
FIG. 1 is an X-ray diffraction spectrum of a quinacridone having a β-type crystal structure.

The present invention will be explained in detail.

<Toner for Developing an Electrostatic Latent Image>

The toner for developing an electrostatic latent image (hereinafter, sometimes simply called "toner") of the present invention comprises toner particles that comprise at least a binder resin and a quinacridone pigment. The quinacridone pigment comprises quinacridone represented by the following structural formula which has a β-type crystal structure and quinacridone represented by the following structural formula which has a γ-type crystal structure.

Although the toner of the invention may be used in both the heat-roll fixing and flash fusing which are general fixing systems, it can exhibit its ability in particular in the case of carrying out flash fusing.

The temperature of the outermost surface of a toner reaches 500° C. in the above flash fusing. For this, a colorant used in, particularly, a flash-fusing toner is not desired to be sublimated and decomposed by intense light (high temperature) unlike the case of heat-roll fixing. However, a known Rhodamine dye is sublimated because it has low heat resistance. Also, even a pigment, for example, the aforementioned C.I. Pigment Red 57:1 is decomposed and sublimated or is deteriorated in a tone by photo-deterioration.

For the above reason, it is necessary to use a quinacridone type pigment superior in heat resistance and weatherability. However, if 2,9-dimethylquinacridone and an unsubstituted quinacridone represented by the above structural formula are used as a magenta toner colorant, they have high heat resistance and the sublimation and decomposition of them are not found. However, it has been found that color reproducibility is slightly deteriorated in the case of carrying out general mixing without carrying out a master batch process because quinacridones differing in chemical structure from each other are mixed.

The above master batch process means a process in which in the case of producing a toner by a molten dispersion/pulverizing method, a colorant and the like are added in advance to a binder resin in a high concentration to carry out molten dispersion and a binder resin is further added to the kneaded product to carry out molten dispersion again, to improve the dispersibility of the colorant and the like in the binder resin when the binder resin, the colorant and the like are molten dispersion.

Also, the aforementioned 2,9-dimethylquinacridone is expensive because it requires a longer production process than the unsubstituted quinacridone represented by the above structural formula. Moreover, as a pigment for a general color toner, a master batch pigment (kneaded product) prepared by dispersing a pigment in a high concentration in the binder resin is usually used. This master batch process is a cause of cost-up in the production of a toner. In order to decrease a cost when producing a toner, it is desired to produce a toner without carrying out the above master batch process.

In addition, when the above 2,9-dimethylquinacridone is used, it is a matter of concern that 2,9-dimethylquinacridone is expensive. Also, if a toner is produced using 2,9-dimethylquinacridone without carrying out a master batch process, there is the problem that a toner having a good color range is not obtained caused by the granulation of a pigment.

The inventors of the invention have made earnest studies concerning the above problem and as a result, the above problem is solved by blending a quinacridone having a β-type crystal structure represented by the above structural formula and a quinacridone having a γ-type crystal structure represented by the above structural formula.

The unsaturated quinacridone represented by the above structural formula is known to take an α, β or γ-type crystal structure. Quinacridones having β or γ-type crystal structure among these crystal structures show peak patterns clearly different from each other in an X-ray diffraction spectrum.

Figure 2:
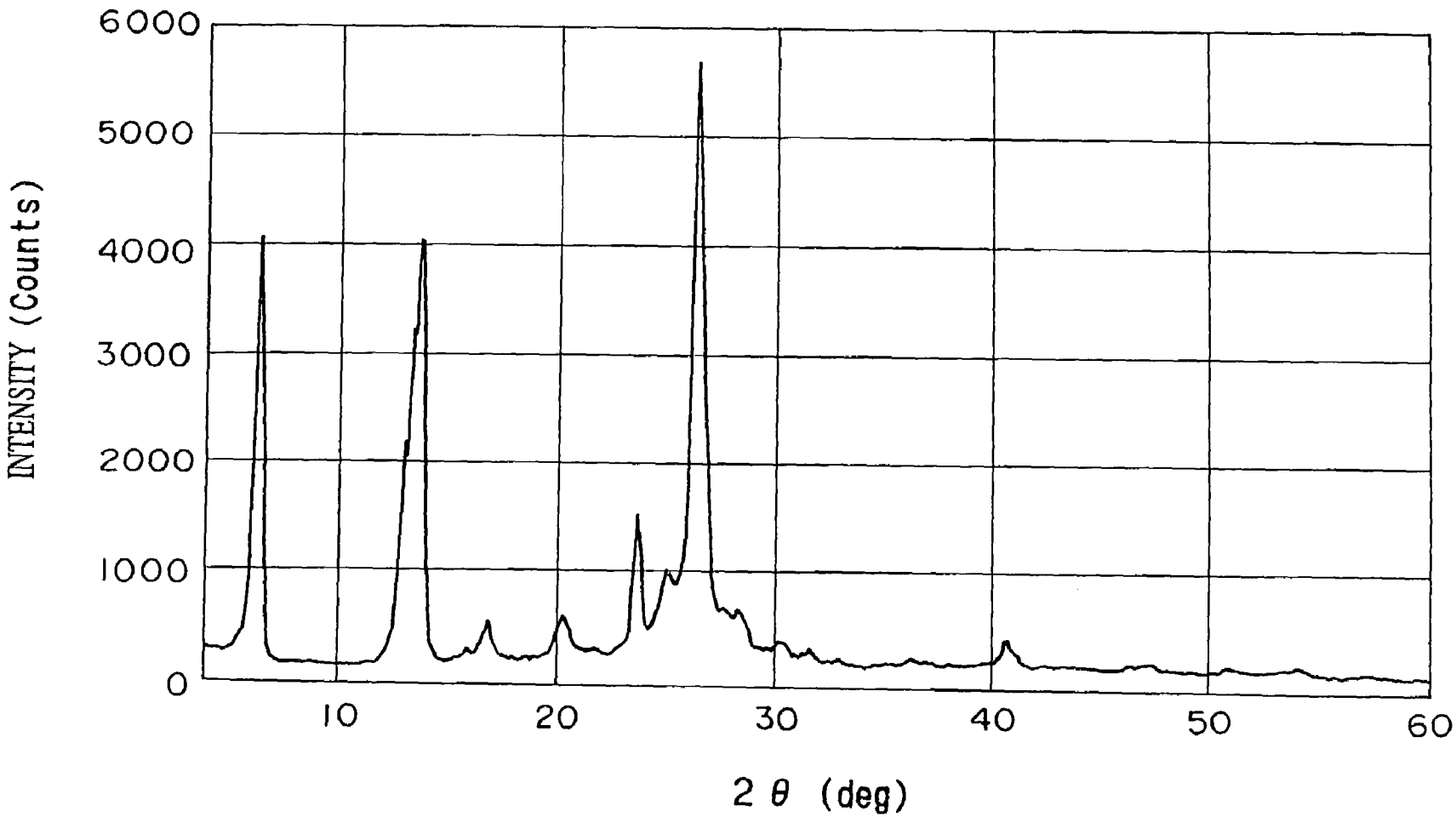
FIG. 2 is an X-ray diffraction spectrum of a quinacridone having a γ-type crystal structure.

FIG. 1 shows the X-ray diffraction spectrum of the above β-type quinacridone and FIG. 2 shows the X-ray diffraction spectrum of the above γ-type quinacridone. As shown in FIGS. 1 and 2, a clear peak is found at 5.7±0.3° in the spectrum of the β-type quinacridone and at 6.3±0.3° in the spectrum of the γ-type quinacridone. The quinacridones having a β-type crystal structure and a γ-type crystal structure respectively in the invention mean the quinacridones having the X-ray diffraction spectrums shown in FIGS. 1 and 2 respectively.

When the above X-ray diffraction is carried out, a sample allowed to stand under 23° C./60% RH for 24 hours or more is used as a sample to be subjected to measurement. In the analysis of an X-ray crystal structure, the crystal structure is found from a diffraction pattern of Bragg angle (2θ) in an X-ray diffraction spectrum using Kα rays of the specific X-rays of Cu. As a measuring device, a heavy-duty type full-automation X-ray diffractometer MXP18 (manufactured by Mac Science) may be used though no particular limitation is imposed on the measuring device. In the invention, the diffraction peak means those having an S-N ratio (signal-noise ratio) of 4 or more.

Just for reference, when the X-ray diffraction of a colorant in a magenta toner, the magenta toner is dissolved in THF (tetrahydrofuran) or chloroform, which is then separated into a soluble one and an insoluble one by using a Soxhlet extraction tube. The insoluble one which is thoroughly dried and allowed to stand under 23° C./60% RH for 24 hours or more is used as a sample. When the magenta toner contains a charge control agent insoluble in THF or chloroform, there is the case where a diffraction pattern originated from this charge control agent appears in an X-ray diffraction spectrum of the measuring sample because this charge control agent is contained in the measuring sample. Therefore, the charge control agent is singly subjected to an X-ray crystal structure analysis to confirm the diffraction pattern of the charge control agent in the X-ray diffraction spectrum in advance. The peaks in the diffraction pattern are eliminated from the above diffraction pattern of the sample and the resulting peaks in the diffraction pattern of the sample are regarded as the peaks of the colorant at the Bragg angle (2θ).

As to the toner of the invention, X-ray diffraction spectrums of the quinacridone pigments contained in the toner can be obtained in the same manner as in the above method.

In the invention, the β-type quinacridone has a violescent red color and the γ-type quinacridone has a yellowish red color. It is therefore possible to adjust the color to a desired magenta color range by mixing the both.

Usually, the β-type quinacridone has a strong violescent color and therefore a system in which this β-type quinacridone is blended tend to have a dark tone. It is therefore difficult to adjust to a color range desired as a magenta toner which will be explained later. In the invention, when mixing the above β-type quinacridone and γ-type quinacridone, the dispersibility of the pigment is raised and, for example, the blending ratio of the both and the total amount of the both as a colorant are controlled to thereby make it possible to use these quinacridones as a colorant of a magenta toner.

Also, because the β-type quinacridone has the same chemical structure as the γ-type quinacridone, no pigment is aggregated without carrying out the above master batch process and a toner having a good color range can be obtained.

In the case of the magenta toner (toner for developing an electrostatic latent image) of the invention, it is preferable that a toner image be transferred such that the amount of the toner stuck to paper (a recording material) is 0.5 mg/cm$^2$ and L*, a* and b* when the fixed image is measured by a body color display method using a CIELAB color space is more preferably 45 or more, 40 or more and in a range of −20 to 20 and still more preferably 50 or more, 60 or more and in a range of −15 to 5 respectively. If L*, a* and b* are not 45 or more, not 40 or more and not in a range of −20 to 20, the tone of magenta is largely shifted in the color reproduction of 4 colors including three colors of yellow, magenta and cyan and a black color and there is therefore the case where a blue or red color system cannot be reproduced.

The upper limits of L* and a* are about 100 and 80, respectively. The aforementioned CIELAB color space means the color space defined in JIS Z8729.

Since the β-type quinacridone has a strong violescent color as aforementioned, the tone as a magenta toner is largely changed according to the amount of the β-type quinacridone to be compounded.

In the invention, the ratio of the quinacridone having the β-type crystal structure represented by the aforementioned structural formula to the quinacridone having the γ-type crystal structure represented by the aforementioned structural formula in the quinacridone pigment used for the toner preferably satisfies the following relation given by the following formula (1).

$$0.25<P\gamma/P\beta<50 \quad (1)$$

In the above formula, Pβ represents the parts by weight of the quinacridone having the β-type crystal structure represented by the aforementioned structural formula based on 100 parts by weight of the toner particles and Pγ represents the parts by weight of the quinacridone having the γ-type crystal structure represented by the aforementioned structural formula based on 100 parts by weight of the toner particles. The above-mentioned toner particles mean particles constituted of a binder resin, a pigment and the like before external additives and the like are added.

With respect to the aforementioned Pγ/Pβ, it is preferable to satisfy the relation $0.25<P\gamma/P\beta<50$, and more preferable to satisfy the relation $4<P\gamma/P\beta<16$.

When Pγ/Pβ is smaller than 0.25, the tint of the toner may be shifted to a blue color side. On the other hand, when Pγ/Pβ is larger than 50, the tint of the toner may be shifted to a yellow color side. In the case of, particularly, a color image, the image color is reproduced by four colors including three primary colors of yellow, magenta and cyan and a black color. If the tone of magenta is largely shifted to a yellow color side, the reproducibility of a blue color which can be output by subtractive color mixing with cyan is greatly deteriorated, which is undesirable.

In the invention, the total amount of the unsubstituted quinacridone having the aforementioned β-type and γ-type crystal structures and added to the toner is in a range of preferably 2 to 15 parts by weight and more preferably 3 to 7 parts by weight based on 100 parts by weight of the toner particles.

When the total amount is smaller than 2 parts by weight, the tinting strength of the toner is dropped, which sometimes leads to the case where a high quality image having a high image density is scarcely obtained however highly the dispersibility of a pigment is improved. When the total amount is more than 15 parts by weight, not only the transparency of the toner is decreased but also there is the case where the reproducibility of intermediate colors such as those typified by human skin colors is decreased. Moreover, the charging characteristics of the toner are unstable, giving rise to the problems such as fogging under a low-temperature and low humidity circumstance and toner scattering under a high-temperature and high-humidity circumstance.

Next, the structural components of the toner for developing an electrostatic latent image of the invention will be explained in more detail. In the image forming method and image forming apparatus of the invention which will be explained later, it is necessary to use, besides a magenta toner, a cyan toner, a yellow toner and a black toner to form a full-color image. The following explanations will be furnished as to the magenta toner together with the above other toners (basically, toners other than the magenta toner are prepared by changing the colorant used in the magenta toner to each colorant).

(Binder Resin)

As the binder resin to be used in the invention, the following binder resins may be used. Although a polyester is preferable as a major component of the binder resin, a copolymer of styrene and an acrylic acid or methacrylic acid, polyvinyl chloride, phenol resin, acryl resin, methacryl resin, polyvinyl acetate, silicone resin, polyurethane, polyamide resin, furan resin, epoxy resin, xylene resin, polyvinylbutyral, terpene resin, cumarone indene resin, petroleum type resin, polyether polyol resin and the like may be used either independently or in combinations of two or more.

The glass transition temperature (Tg) of the binder resin used in the invention is preferably in a range of 50 to 70° C. from the viewpoint of preserving stability (anti-blocking characteristics of a toner).

(Infrared Absorbent)

The toner for developing an electrostatic latent image of the invention preferably contains an infrared absorbent. Here, the infrared absorbent means a material having at least one or more strong light absorption peak in a near infrared range of 750 to 1200 nm when the absorbent is measured using a spectrophotometer or the like.

In the invention, a known inorganic or organic material may be used insofar as it is such an infrared absorbent. Specifically, the following materials may be utilized.

Namely, examples of the inorganic infrared absorbent may include lanthanoid compounds such as ytterbium oxide and ytterbium phosphate, indiumtin oxide and tin oxide. Examples of organic infrared absorbent may include aminium compounds, diimonium compounds, naphthalocyanine type compounds, cyanine type compounds, polymethine type compounds and polyazo compounds. The infrared absorbent is not limited to these compounds. These compounds may be used in combinations.

The amount of the infrared absorbent to be added is preferably in a range of 0.01 to 5 parts by weight and more preferably in a range of 0.1 to 5 parts by weight based on 100 parts by weight of the toner particles. When the amount to be added is less than 0.01 parts by weight, the toner cannot be fixed in the case of flash fusing. When the amount exceeds 5 parts by weight, there is the case where the color of the toner is clouded.

Even in the case where the toner for developing an electrostatic latent image contains the infrared absorbent, L*, a* and b* in the CIELAB color space are respectively preferably in the above range.

(Colorant)

Although no particular limitation is imposed on each colorant of the above black, yellow and cyan toners, carbon black, lamp black, iron black, ultramarine blue, nigrosine dyes and aniline blue are preferably used as a black toner.

As a colorant for the yellow toner, compounds represented by condensed azo compounds, isoindolinone compounds, anthraquinone compounds, azo metal complexes, methine compounds and allylamide compounds are used.

Specifically, C.I. Pigment Yellow 12, 13, 14, 15, 17, 62, 74, 83, 93, 94, 95, 109, 110, 111, 128, 129, 147, 168, 180 and 185 are preferably used. Particularly, C.I. Pigment Yellow 180 or 185 is preferably used from the viewpoint of tone.

As a colorant for the cyan toner, copper phthalocyanine compounds or their derivatives, anthraquinone compounds, basic dye lake compounds and the like may be utilized.

Specifically, C.I. Pigment Blue 1, 7, 15, 15:1, 15:2, 15:3, 15:4, 60, 62, 66 and the like may be preferably utilized. Particularly, C.I. Blue 15 and 15:3 are preferably used from the viewpoint of tone.

The amount of each colorant used in the aforementioned black, cyan and yellow toners is preferably in a range of 1 to 20 parts by weight based on 100 parts by weight of the toner particles.

With regard to the magenta toner of the invention, various pigments and dyes may be used in combination with the aforementioned unsaturated quinacridones having β-type and γ-type crystal structures respectively as the magenta colorant. For example, a condensed azo compound, diketopyrrolopyrrole compound, anthraquinone, quinacridone compound, basic dye lake compound, naphthol compound, benzimidazole compound, thioindigo compound and perillene compound may be used.

Specific examples of these pigments or dyes include C.I. Pigment Red 2, 3, 5, 6, 7, 23, 48:2, 48:3, 48:4, 57:1, 81:1, 122, 144, 146, 166, 169, 177, 184, 185, 202, 206, 220, 221, 254 and 269.

The magenta colorant other than the unsubstituted quinacridones having a β-type or γ-type crystal structure is preferably contained in an amount of 0.01 to 10 parts by weight based on 100 parts by weight of the toner particles.

(Wax)

The toner of the invention may contain various waxes.

As the wax to be used, ester wax, polyethylene, polypropylene and copolymers of ethylene and propylene are most preferable. Examples of the wax include polyglycerin wax, microcrystalline wax, paraffin wax, carnauba wax, sazole wax, montanate wax, deoxidized carnauba wax, unsaturated fatty acids such as palmitic acid, stearic acid, montanic acid, plandinic acid, eleostearic acid and valinalic acid; saturated alcohols such as stearin alcohol, aralkyl alcohol, behenyl alcohol, carnaubil alcohol, ceryl alcohol, melissyl alcohol and long-chain alkyl alcohols having a longer-chain alkyl group; polhydric alcohols such as sorbitol; fatty acid amides such as linoleic acid amide, oleic acid amide and lauric acid amide; saturated fatty acid bisamides such as methylenebisstearic acid amide, ethylenebiscapric acid amide, ethylenebislauric acid amide and hexamethylenebisstearic acid amide; unsaturated fatty acid amides such as ethylenebisoleic acid amide, hexamethylenebisoleic acid amide, N,N'-dioleyladipic acid amide and N,N'-dioleylcebasic acid amide; aromatic bisamides such as m-xylenebisstearic acid amide and N,N'-distearylisophthalic acid amide; fatty acid metal salts (generally so-called metal soaps) such as calcium stearate, calcium laurate, zinc stearate and magnesium stearate; grafted waxes such as those prepared by grafting a vinyl type monomer such as styrene or acrylic acid onto aliphatic hydrocarbon type wax; partially esterified products of a fatty acid such as behenic acid monoglyceride and a polyhydric alcohol; and methyl ester compounds having a hydroxyl group and obtained by hydrogenating vegetable oil and fats.

Here, as the wax used for the toner, a wax material having a heat absorption peak in a temperature range of 50 to 90° C. in DSC (differential scanning type calorimeter, temperature rise rate: 5° C./min) is preferable. This reason is that if the heat absorption peak is less than 50° C., there is the case where the toner is easily blocked whereas if the heat absorption temperature is higher than 90° C., there is the case where the wax does not contribute to fixing. Also, the toner for developing an electrostatic latent image is used for heat-roll fixing. In this case, the aforementioned wax acts as a releasing agent.

In the above DSC measurement, it is preferable to measure using an internal heat input compensation type differential scanning calorimeter with high accuracy in light of measuring principle.

The amount of the wax used in the toner is preferably in a range of 0.1 to 10 parts by weight based on 100 parts by weight of the toner particles.

(Other Components)

Besides the binder resin, colorant, infrared absorbent and wax, other components (e.g., fine particles and charge control agent) may be added to the toner for developing an electrostatic latent image of the invention either internally or externally.

For example, as the charge control agent, a known Calyx allene, nigrosine type dye, quaternary ammonium salt, amino group-containing polymer, metal-containing azo dye, complex compound of salicylic acid, phenol compound, azochrome type, azozinc type and the like may be used.

Other than the above, a magnetic toner prepared by compounding a magnetic material such as an iron powder, magnetite and ferrite in the toner may also be used. Particularly, in the case of a color toner, a white magnetic powder may be used.

White inorganic fine particles such as a fluidity improver may also be used as an external additive in the toner of the invention. The proportion of the fine particles to be added externally is in a range of 0.01 to 5 parts by weight and preferably in a range of 0.01 to 2.0 parts by weight based on 100 parts by weight of the toner particles.

Examples of the inorganic fine powder include fine powders of, for example, silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. Among these compounds, a silica fine powder is particularly preferable.

Also, known materials such as resin fine powder may be used in combination with the above inorganic fine powder. Moreover, a metal salt of higher fatty acid represented by zinc stearate and fluorine type high-molecular weight fine particle powder may be added as a cleaning activator.

(Method of Producing a Toner)

Next, the method of producing the toner for developing an electrostatic latent image of the invention will be explained. The magenta toner of the invention can be produced in the same method as in known methods of producing a toner such as a pulverizing method and polymerization method.

In the case of using the pulverizing method, the toner of the invention can be produced, for example, in the following manner. First, the binder resin pigments as a colorant and other additives are thoroughly mixed by a mixer such as a Henschel mixer or ball mill and then molten dispersed using a heat kneader such as a heat roll, kneader or extruder. Then, pigments are dispersed in the resulting solution, which is then cooled to solidify. Then, the resulting molten dispersed product is coarsely pulverized and then pulverized finely by using a jet mill. After that, the coarsely pulverized particles are subjected to pulverizing and classification in which these particles are finely pulverized by a jet mill and classified by a pneumatic classifier, to obtain the toner particles.

In the above molten dispersion, it is not preferable to carry out a master-batch process of a pigment to avoid cost-up as mentioned above. Because the method of producing the toner of the invention uses quinacridones having the same chemical structures as a colorant as mentioned above, a pigment is not aggregated in usual molten dispersion and in this method, sufficient pigment (colorant) dispersibility can be obtained without carrying out a master-batch process.

Further, according to the need, desired additives such as the aforementioned external additives are blended by a mixer such as a Henschel mixer, whereby a toner for developing an electrostatic latent image according to the invention can be obtained.

Also, in the case of using the polymerization method, a suspension polymerization method or an emulsion polymerization method may be primarily used.

When the toner for developing an electrostatic latent image of the invention is produced using a suspension polymerization method, it may be produced, for example, in the following manner. First, a monomer such as styrene, n-butylacrylate or 2-ethylhexylacrylate, a crosslinking agent such as divinylbenzene, a chain transfer agent such as dodecyl mercaptan and an initiator are compounded and, as required, a charge control agent and wax, infrared absorbent are further compounded in the aforementioned quinacridone pigments to produce a monomer composition.

After that, the above monomer composition is poured into a water phase containing calcium triphosphate, a suspension stabilizer such as a polyvinyl alcohol and a surfactant to form an emulsion by using a rotor stator type emulsifier, pressure type emulsifier, ultrasonic emulsifier or the like. Then, the emulsion is heated to polymerize the monomer to obtain particles. After the polymerization is finished, the obtained particles are washed and dried. Then, external additives are added according to the need to obtain the toner of the invention.

Also, in the case of producing the toner by an emulsion polymerization method, it may be produced, for example, in the following manner. First, a monomer such as styrene, n-butylacrylate or 2-ethylhexylacrylate is added in water in which a water-soluble initiator such as potassium persulfate is dissolved and a surfactant such as sodium dodecysulfate is added to the solution according to the need. The mixture is heated with stirring to run polymerization thereby obtaining resin particles (resin particle forming step).

After that, besides the aforementioned colorant and powders such as a charge control agent and a wax, infrared absorbent composition are added in the suspension in which the resin particles are dispersed. The pH, stirring strength, temperature and the like of the suspension are controlled to hetero-aggregate the resin particles, colorant powder and others powder, thereby obtaining a hetero-aggregate (aggregation step). Further, the reaction system is heated to a temperature higher than the glass transition temperature of the resin particles to coalesce the hetero-aggregate to obtain the toner particles (coalescing step). After that, the toner particles are washed and dried and then, external additives are added according to the need to obtain the magenta toner of the invention.

In the invention, a polyester resin is preferably used as the binder resin as mentioned above. The aforementioned emulsion aggregation method may also be adopted in the case of forming the toner particles by a wet method using this polyester resin as the binder resin. In this case, as the aforementioned resin particle formation step, an emulsion particle formation step is carried out in which shearing force is applied to a solution prepared by mixing an aqueous medium with a mixed solution (polymer solution) containing a polyester resin which is, for example, sulfonated and, as required, a colorant, to form emulsion particles (liquid droplets), whereby the toner particles can be produced in the same manner as above. As to a variation in the shape of the toner, it may have a true sphere form to a form like a bunch of grapes.

The volume average particle diameter of the toner particles produced in this manner is preferably in a range of 1 to 10 μm and more preferably in a range of 3 to 7 μm.

Next, an electrophotographic developer using the toner for developing an electrostatic latent image of the invention will be explained. The electrophotographic developer (hereinafter abbreviated as "developer" if necessary) may be either a one-component developer constituted of the toner of the invention or a two-component developer constituted of a carrier and the toner of the invention. Detail explanations will be furnished as to the case where the developer of the invention is a two-component developer.

No particular limitation is imposed on the carrier which may be used in the above two-component developer and a known carrier may be used. Examples of the carrier may include a resin coated carrier having a resin coating layer on the surface of a core material. Also, the carrier may be a resin dispersion type carrier in which a conductive material is dispersed in a matrix resin.

Examples of the coating resin/matrix resin used for the carrier may include, though not limited to, a polyethylene, polypropylene, polystyrene, polyvinyl acetate, polyvinyl alcohol, polyvinylbutyral, polyvinyl chloride, polyvinyl ether, polyvinyl ketone, vinyl chloride/vinyl acetate copolymer, styrene/acrylic acid copolymer, straight-silicone resin constituted of organosiloxane bonds or its modified products, fluororesin, polyester, polycarbonate, phenol resin and epoxy resin.

Examples of the electroconductive material may include, though not limited to, metals such as gold, silver and copper, carbon black, titanium oxide, zinc oxide, barium sulfate, aluminum borate, potassium titanate, tin oxide and carbon black.

Examples of the core material of the carrier include magnetic metals such as iron, nickel and cobalt, magnetic oxides such as ferrite and magnetite and glass beads. The core material is preferably magnetic materials to use the carrier in a magnetic brush method. The volume average particle diameter of the core material of the carrier is generally 10 to 500 μm and preferably 30 to 100 μm.

In order to coat the surface of the core material of the carrier with a resin, a method of coating the surface with a coating layer forming solution prepared by dissolving the above coating resin, and as required, various additives in a proper solvent. No particular limitation is imposed on the solvent and the solvent may be appropriately selected in consideration of a coating resin to be used and coating aptitude. As the resin to be applied, a silicone resin is preferably used though no particular limitation is imposed on the resin.

Specific examples of the method of applying a resin include a dipping method in which a carrier core material is dipped in a coating layer forming solution, a spray method in which a coating layer forming solution is sprayed on the surface of a core material of a carrier, a fluidized-bed method in which a coating layer forming solution is sprayed on a core material of a carrier floated by air and a kneader-coater method in which a core material of a carrier and a coating layer forming solution are mixed in a kneader-coater, followed by removing a solvent.

The mixing ratio (ratio by weight) of the electrostatic developing toner of the invention to the carrier (toner:carrier) is in a range of about 1:100 to 30:100 and preferably about 3:100 to 20:100.

<Image Forming Method>

Next, the image forming method of the invention will be explained. No particular limitation is imposed on the image forming method of the invention insofar as it uses at least a developer containing the above-described toner of the invention. The following image forming method can be raised as a preferable image forming method.

The image forming method of the invention includes: forming an electrostatic latent image on a surface of an electrostatic latent image holding member, developing the electrostatic latent image on the surface of the electrostatic latent image holding member to form a toner image, transferring the toner image to a surface of a transfer-receiving material, and fixing the toner image transferred to a surface of a recording material to form an image. Here, when the transfer-receiving material is an intermediate transferring member, the toner image may be transferred from the transfer-receiving material to a surface of a recording material. When no intermediate material is used, the transfer-receiving material functions as a recording material as it is. In the present invention, it is particularly preferable to use a developer containing the magenta toner of the invention. In general, the magenta toner is used in combination with developers containing toners having other colors such as cyan, yellow and black.

The aforementioned each step may be performed by a known method adopted in a usual image forming method. The image forming method may include a step other than the above steps; such a step may include cleaning a surface of the latent image holding member.

An image is formed by the image forming method of the invention in the following manner when an electrophotographic photosensitive material is utilized as the electrostatic latent image holding member. First, the surface of the electrophotographic photosensitive material is evenly charged by a corotron charger, contact charger or the like and then exposed to light to form an electrostatic latent image. Next, the surface of the photosensitive material is brought into contact with a developer holding member having a developer layer formed on its surface to make toner particles adhere to the electrostatic latent image to form a toner image on the surface of the electrophotographic photosensitive material. The formed toner image is transferred to the surface of the transfer-receiving material such as paper by utilizing a corotron charger or the like. Further, the toner image transferred to the recording material is fixed by a fixing device to form an image on the image-receiving material. Here, when there is no intermediate member, the transfer-receiving material may functions as the recording material as it is.

As the electrophotographic photosensitive material, an inorganic photosensitive material such as amorphous silicon or serene or an organic photosensitive material using a polysilane or phthalocyanine as a charge generation layer or charge transfer layer may be used. Particularly, an amorphous silicon photosensitive material is preferable because it has a long life.

In the case of using toners having four colors including, besides the magenta toner of the invention, a cyan toner, yellow toner and black toner, these toners containing an infrared absorbent for flash fusing, when forming an image, the above fixing may be carried out every time when each color toner image is transferred to the recording material or may be carried out simultaneously at a time after four color toner images are all transferred to the recording material.

In the invention, the above fixing may be carried out by a contact type heat-roll fixing or by non-contact type flash fusing. The fixing is preferably carried out by flash fusing in view of high-speed fixing corresponding to a high-speed operation of a device (increase in the number of output images per minute).

Light energy (fixing energy) in the flash fusing is preferably in a range of 1 to 7 J/cm$^2$ and more preferably in a range of 2 to 5 J/cm$^2$. Specifically, when transferring a toner image to an recording material every each color toner image to carry out flash fusing (hereinafter referred to as "monocolor flash fusing" if necessary), the light energy is preferably in a range of about 1 to 3 J/cm$^2$. In the case of transferring four color toner images multi-layer to fix simultaneously (hereinafter referred to as "four color collective flash fusing" if necessary), the light energy is preferably in a range of about 2 to 7 J/cm$^2$ and more preferably in a range of 3 to 5 J/cm$^2$.

When the fixing energy is less than 1 J/cm$^2$ in the monocolor flash fusing or less than 2 J/cm$^2$ in the four color collective flash fusing, there is the case where good fixing is not accomplished. When the fixing energy exceeds 3 J/cm$^2$ in the monocolor flash fusing or exceeds 7 J/cm$^2$ in the four color collective flash fusing, there is the case where toner voids and burnt deposits of a recording medium are caused.

As a flash-fusing device used in the flash fusing, a light source (lamp), such as a mercury lamp, halogen lamp and xenon lamp, which can emit infrared rays in the near-infrared region may be utilized. The number of lamps to be used may be one or two or more.

It is preferable to use a xenon lamp as the light source in the invention in view of improving the light absorption efficiency of the infrared absorbent used in the invention more efficiently and in view of obtaining good fixing ability.

To state just for reference, the emission energy of one fusing flash per unit area, which energy shows the strength of a xenon lamp is given by the following equation (2).

$$S=((1/2)\times C\times V^2)/(u\times l)/(n\times f) \quad (2)$$

In the equation (2), n represents the number of lamps (number), f represents a lighting frequency (Hz), V represents an input voltage (V), C represents a condenser capacity (μF), u represents a process carrier speed (mm/s), l represents a print width (mm) and S represents an energy density (J/cm$^2$).

<Image Forming Apparatus>

Next, one example of the image forming apparatus of the invention will be explained with reference to the drawings.

Figure 3:
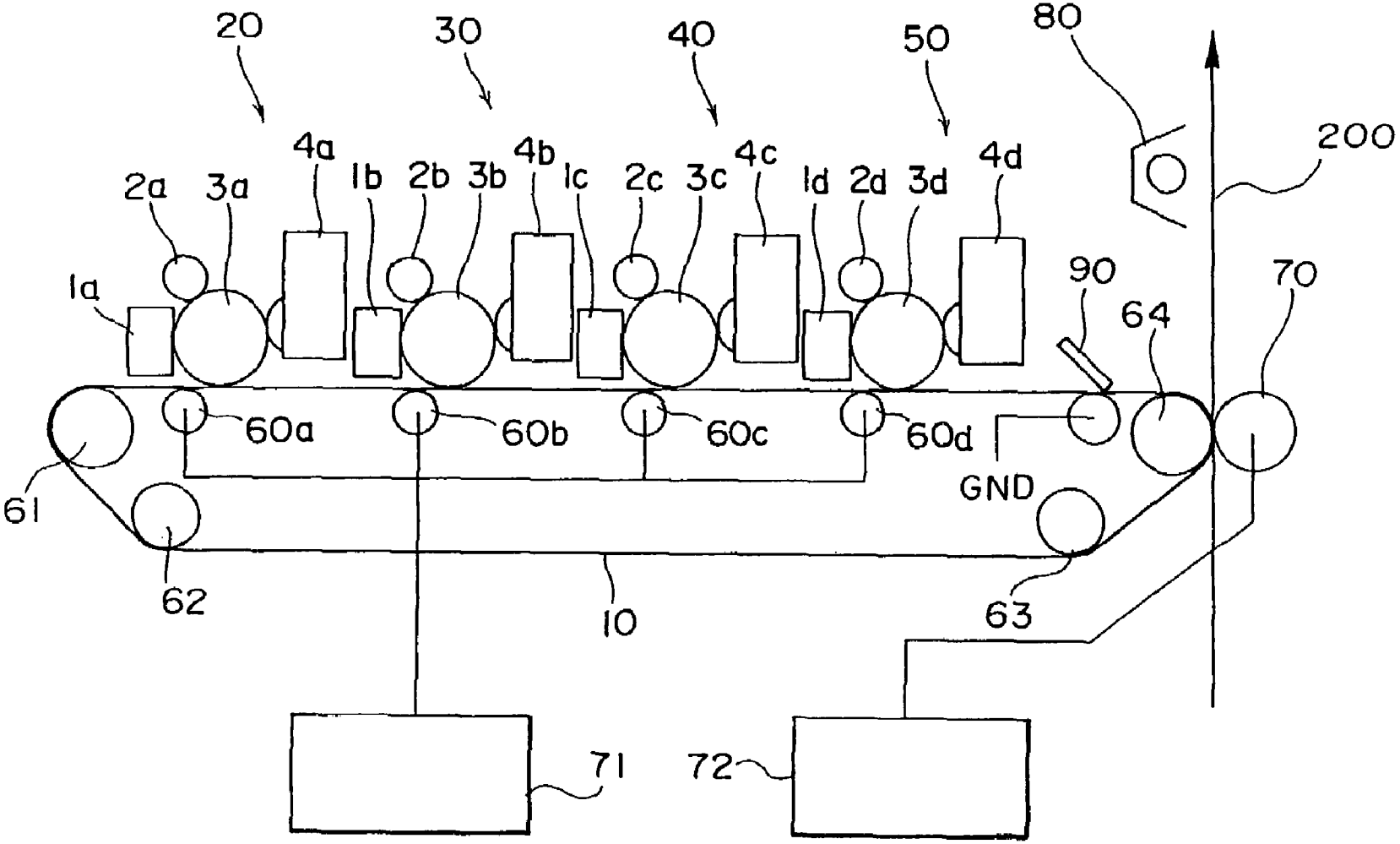
FIG. 3 is a schematically typical view showing one example of an image forming apparatus according to the invention.

FIG. 3 is a schematically typical view showing one example of the image forming apparatus of the invention. In FIG. 3, 1*a* to 1*d* represent charging unit, 2*a* to 2*d* represent exposure unit, 3*a* to 3*d* represent electrostatic latent image holding members (photosensitive material), 4*a* to 4*d* represent developing units, 10 represents an intermediate transfer material (transfer-receiving material), 20 represents a black developing unit, 30 represents a cyan developing unit, 40 represents a magenta developing unit, 50 represents a yellow developing unit, 60*a* to 60*d* represent first transfer unit (transfer roller), 61, 62, 63 and 64 represent rollers, 70 represents a second transfer unit (transfer roller), 71 represents a primary transfer voltage supply unit, 72 represents a secondary transfer voltage supply unit, 80 represents a flash-fusing unit, 90 represents a cleaning unit, 100 represents an image forming apparatus and 200 represents an recording material.

The image forming apparatus 100 shown in FIG. 3 is constituted of the developing devices of each color including an charging unit, exposure unit, photosensitive materials and developing unit and represented by the symbols 20, 30, 40 and 50 respectively, the intermediate transfer material 10, the rolls 61, 62, 63 and 64 which are disposed in contact with the inside peripheral surface of the intermediate transfer material 10 and tensely hang the intermediate transfer material 10, transfer rolls 60*a*, 60*b*, 60*c* and 60*d* which are disposed in contact with the inside peripheral surface of the photosensitive materials of each developing device through the intermediate transfer material 10 such that they are pressed to the photosensitive materials, the primary transfer voltage supply unit 71 that supplies voltage to these four transfer rolls, the transfer roll 70 disposed opposite to the transfer roll 64 through the intermediate transfer material 10 such that it is pressed to the transfer roll 64, the secondary transfer voltage supply unit 72 that supplies voltage to the transfer roll 70, the cleaning unit 90 that cleans the outside peripheral surface of the intermediate transfer material 10 and a flash-fusing unit 80 that emits light to the side which is in contact with the intermediate transfer material 10 on the recording medium 200 that passes in the direction of the arrow through the nip part of the intermediate transfer material 10 part carried on the roll 64 and the transfer roll 70.

The black developing device 20 has a structure in which the charging unit 1*a*, the exposure means 2*a* and the developing unit 4*a* are arranged clockwise around the photosensitive material 3*a*. Also, the transfer roll 60*a* is disposed opposite to the photosensitive material 3*a* through the intermediate transfer material 10 such that it is in contact with the developing unit 4*a* corresponding to the part extending clockwise from the position where the developing unit 4*a* is disposed to the position where the charging unit 1*a* is disposed. Such a structure is similar to each developing device of other colors. In the image forming apparatus of the invention, a developer containing the magenta toner of the invention is stored in the developing unit 4*c* of the magenta developing device 40 and a flash-fusing toner corresponding to each color is stored in the developing unit of other developing devices.

Also, the black developing device 20, the cyan developing device 30, the magenta developing device 40, the yellow developing device 50, the cleaning unit 90 (peeling claw side) and the transfer roll 70 are disposed clockwise in this order on the outside peripheral surface of the intermediate transfer material 10 such that they are in contact with the outside peripheral surface. The transfer rolls 60*a*, 60*b*, 60*c* and 60*d*, the cleaning means 90 (roll side) and rolls 64, 63, 62 and 61 are disposed clockwise in this order on the inside peripheral surface of the intermediate transfer material 10.

Next image formation using the image forming apparatus 100 will be explained. First, in the black developing device 20, the surface of the photosensitive material 3*a* is evenly charged by the charging unit 1*a* with rotating the photosensitive material 3*a* clockwise. Next, the charged photosensitive material 3*a* is exposed to light by the exposure unit 2*a* whereby a latent image corresponding to an image of the black component of an original image to be reproduced is formed on the surface of the photosensitive material 3*a*. Moreover, a black toner stored in the developing unit 4 is imparted to the latent image to develop the latent image thereby forming a black toner image. This process is conducted in the same manner in the cyan developing device 30, the magenta developing device 40 and the yellow developing device 50 to thereby form each color toner image on the surface of the photosensitive material in each developing device.

Each color toner image formed on the surface of the photosensitive material is transferred one by one to the intermediate transfer material 10, which rotates counterclockwise, by the action of transfer potential applied by the transfer rolls 60*a* to 60*d* and formed multiple layer on the outside peripheral surface of the intermediate transfer material 10 corresponding to the original image information, whereby a full-color layered toner image of black, cyan, magenta and yellow is formed.

Next, when the multiple layered toner image on the intermediate transfer material 10 is conveyed to the nip part of the roll 64 and the transfer roll 70, it is transferred to the recording medium 200 by the action of the transfer potential of the transfer roll 70. Then, the multiple layered toner image transferred to the recording medium 200 is conveyed to the flash-fusing means 80, where it is irradiated with light from the flash-fusing means 80 to melt, whereby a flash-fused full-color image is formed on the recording medium 200.

A toner left on the intermediate transfer material 10 after the transfer of the multiple layered toner image to the recording medium 200 is removed by the cleaning unit 90 provided with a peeling claw such as a cleaning blade.

EXAMPLES

The present invention will be hereinafter explained in detail by way of examples. However, the examples should not be construed to limit the scope of the invention.

(1) Production of a Toner

A toner raw material containing a binder (binder resin), a charge control agent, wax, a pigment and an infrared absorbent as shown in Tables 1 and 2 is poured into a Henschel mixer and premixed. Then, the mixture is kneaded by an extruder (PCM-30, manufactured by Ikegai Corporation) at 100 to 110° C. at 250 rpm. Then, the kneaded mixture is coarsely crushed by a hammer mill and pulverized by a jet mill. The pulverized particles are classified by an air classifier to obtain the toner particles having a volume average particle diameter of 7.3 μm.

Next, 0.5 parts by weight of hydrophobic silica fine particles (TG820F, manufactured by Cabot) is externally added to 100 parts by weight of the toner particles to obtain magenta toners (FCM-2 to 11, 13 to 19 and 25) used in each example and magenta toners (FCM-1, 12 and 20-24) used in each comparative example.

(2) Evaluation

Figure 4:
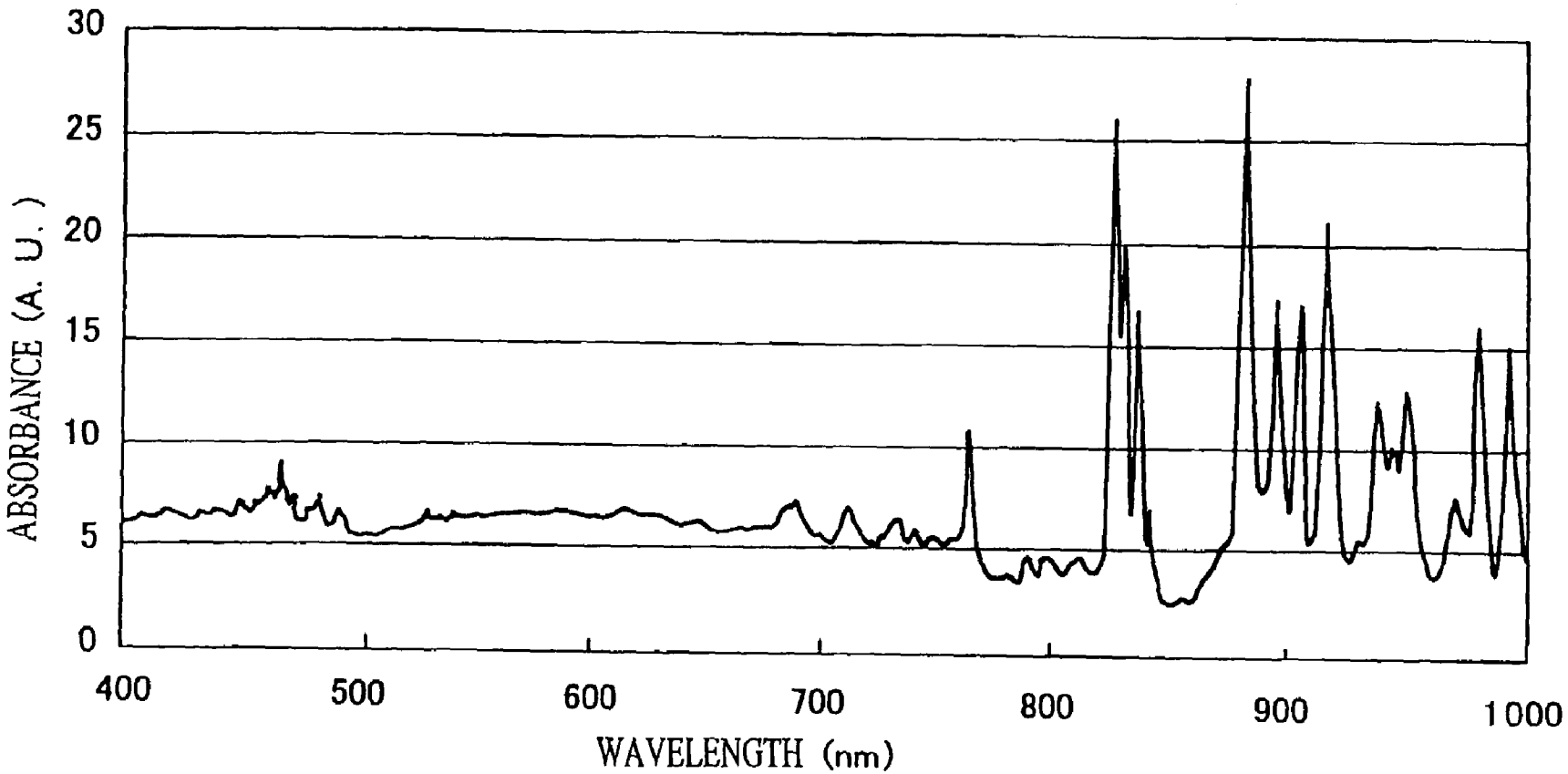
FIG. 4 is a graph showing the emission waveform of a flash lamp.

In the formation of an image for the evaluation of the following tone, light fastness and flash resistance, an image forming apparatus (high-speed flash fusing printer DocuPrint 1100 CF, manufactured by Fuji Xerox, two-component developing system, printing speed: 1000 sheets/min) having the foregoing structure shown in FIG. 3 is used as a device. The emission waveform of the flash lamp used in the flash-fusing device of the image forming apparatus is shown in FIG. 4 for reference. FIG. 4 is a graph showing the emission waveform of the flash lamp, wherein the abscissa is the wavelength (nm) and the ordinate is the absorbance (a. u.). As is clear from FIG. 4, it is found that strong emission is observed in a near-infrared region of 750 nm or more. Also, the energy of a flash during the formation of an image is made to be 3.2 J/cm$^2$.

a) Color Range

In the evaluation, a solid image constituted only of each magenta toner obtained in Examples and Comparative Examples on a plain paper such that the amount of the magenta toner stuck to the paper is 0.5 mg/cm$^2$ to rate the color range of the fixed image by values measured as to color reproducibility (L*, a*, b*) and by measuring with the eye. It is to be noted that each value of the above L*, a* and b* is measured by a spectrometer (938 Spectrodensitometer, manufactured by X-Rite).

The color range is evaluated based on the measured results of the color reproducibility measuring values (L*, a*, b*) and on the visual judgment according to the following criteria. The following S (chromaticity) means $(L^{*2}+a^{*2}+b^{*2})^{1/2}$.

◎: $S \geqq 80$, $-12<b^*<5$

○: $60 \leqq S<80$, $-12 \leqq b^* \leqq 4.5$

Δ: $60 \leqq S<80$, $b^*<-12$, $4.5<b^*$

X: $S<60$

The results are shown in Tables 1 and 2.

b) Ecological Properties

When the pigment in the toner used in each example or comparative example does not include a halogen (halogen-free), ecological property is judged as "○". When the pigment in the toner used in each example or comparative example includes a halogen (not halogen-free), ecological property is judged as "X".

The results are shown in Tables 1 and 2.

c) Light Fastness

An image produced in the same manner as in the case of a) by using the magenta toner obtained in each example or comparative example is allowed to stand outdoors for one month and the resulting image is evaluated according to the following criteria. The following ΔE (color difference) means $\{(L_0^*-L_1^*)^2+(a_0^*-a_1^*)^2+(b_0^*-b_1^*)^2\}^{1/2}$. Here, $L_0^*$, $a_0^*$ and $b_0^*$ show values measured before the sample is allowed to stand outdoors and $L_1^*$, $a_1^*$ and $b_1^*$ show values measured after the sample is allowed to stand outdoors. In this case, a print sample in which the amount of a toner to be stuck is made to be 0.45 to 0.5 mg/cm$^2$ is used.

○: $\Delta E \leqq 5$

X: $5<\Delta E \leqq 10$

XX: $10<\Delta E$

The results are shown collectively in Tables 1 and 2.

d) Flash Resistance

An image produced in the same manner as in the case of a) by using the magenta toner obtained in each example or comparative example is evaluated according to the following criteria.

○: Print bleeding due to a pigment sublimate is not found around printings. A desmoking filter is not colored by a pigment sublimate even in continuous printing of 1,000,000 sheets at a 4% printing rate.

Δ: Almost no printing bleeding is observed around printings, but the sublimated pigment component is stuck to a desmoking filter when carrying out continuous printing of 1,000,000 sheets.

X: Printing bleeding appears.

The results are shown collectively in Tables 1 and 2.

As to the above evaluation, Examples 1 to 17 and Comparative Example are evaluated for an image which is processed by the above flash fusing whereas Example 18 is evaluated for an image which is produced using a heat roll fixing printer (DocuCentre 402FS, manufactured by Fuji Xerox Co., Ltd.) according to the same evaluation criteria as above.

TABLE 1

| | Toner | Binder resin FP118 (parts by weight) | Charge control agent PSY (parts by weight) | Infrared absorbent YKR5010 (parts by weight) | Wax 550P (parts by weight) | Pigment: C.I. Pigment Violet 19 (γ-type) (parts by weight) | Pigment: C.I. Pigment Violet 19 (β-type) (parts by weight) | Pigment: Total amount (parts by weight) |
|---|---|---|---|---|---|---|---|---|
| Comparative Example 1 | FCM-1 | 92.5 | 1 | 0.5 | 1 | 5 | 0 | 5 |
| Example 1 | FCM-2 | 92.5 | 1 | 0.5 | 1 | 4.95 | 0.05 | 5 |
| Example 2 | FCM-3 | 92.5 | 1 | 0.5 | 1 | 4.9 | 0.1 | 5 |
| Example 3 | FCM-4 | 92.5 | 1 | 0.5 | 1 | 4.7 | 0.3 | 5 |
| Example 4 | FCM-5 | 92.5 | 1 | 0.5 | 1 | 4.5 | 0.5 | 5 |
| Example 5 | FCM-6 | 92.5 | 1 | 0.5 | 1 | 4 | 1 | 5 |
| Example 6 | FCM-7 | 92.5 | 1 | 0.5 | 1 | 3 | 2 | 5 |
| Example 7 | FCM-8 | 92.5 | 1 | 0.5 | 1 | 2.5 | 2.5 | 5 |
| Example 8 | FCM-9 | 92.5 | 1 | 0.5 | 1 | 2 | 3 | 5 |
| Example 9 | FCM-10 | 92.5 | 1 | 0.5 | 1 | 1 | 4 | 5 |
| Example 10 | FCM-11 | 92.5 | 1 | 0.5 | 1 | 0.5 | 4.5 | 5 |
| Comparative Example 2 | FCM-12 | 92.5 | 1 | 0.5 | 1 | 0 | 5 | 5 |
| Example 11 | FCM-13 | 96.4 | 1 | 0.5 | 1 | 1 | 0.1 | 1.1 |
| Example 12 | FCM-14 | 95.3 | 1 | 0.5 | 1 | 2 | 0.2 | 2.2 |
| Example 13 | FCM-15 | 94.2 | 1 | 0.5 | 1 | 3 | 0.3 | 3.3 |
| Example 14 | FCM-16 | 89.8 | 1 | 0.5 | 1 | 7 | 0.7 | 7.7 |
| Example 15 | FCM-17 | 86.5 | 1 | 0.5 | 1 | 10 | 1 | 11 |
| Example 16 | FCM-18 | 81 | 1 | 0.5 | 1 | 15 | 1.5 | 16.5 |
| Example 17 | FCM-19 | 75.5 | 1 | 0.5 | 1 | 20 | 2 | 22 |

| | Toner | Pγ/Pβ | Color range: L* | a* | b* | Chromaticity | Tone | Tone judgment | Ecological properties | Light fastness | Flash resistance |
|---|---|---|---|---|---|---|---|---|---|---|---|
| Comparative Example 1 | FCM-1 | — | 52 | 56 | 8.5 | 77 | Yellowish | X | ○ | ○ | ○ |
| Example 1 | FCM-2 | 99 | 52 | 56 | 4.9 | 77 | Slightly yellowish | Δ | ○ | ○ | ○ |
| Example 2 | FCM-3 | 49 | 52 | 58 | 4.2 | 78 | Good | ○ | ○ | ○ | ○ |
| Example 3 | FCM-4 | 18 | 52 | 61 | 3.9 | 80 | Very good | ◎ | ○ | ○ | ○ |
| Example 4 | FCM-5 | 9 | 51 | 62 | 1.5 | 80 | Very good | ◎ | ○ | ○ | ○ |
| Example 5 | FCM-6 | 4 | 50 | 62 | −0.5 | 80 | Very good | ◎ | ○ | ○ | ○ |
| Example 6 | FCM-7 | 1.5 | 49 | 56 | −4.2 | 75 | Good | ○ | ○ | ○ | ○ |
| Example 7 | FCM-8 | 1 | 48 | 52 | −5.6 | 71 | Good | ○ | ○ | ○ | ○ |
| Example 8 | FCM-9 | 0.7 | 47 | 48 | −7.6 | 68 | Good | ○ | ○ | ○ | ○ |
| Example 9 | FCM-10 | 0.25 | 47 | 44 | −11.6 | 65 | Good | ○ | ○ | ○ | ○ |
| Example 10 | FCM-11 | 0.11 | 47 | 43 | −15.6 | 66 | Slightly bluish | Δ | ○ | ○ | ○ |
| Comparative Example 2 | FCM-12 | 0 | 47 | 40 | −24.5 | 66 | Bluish | X | ○ | ○ | ○ |
| Example 11 | FCM-13 | 10 | 68 | 25 | 1.5 | 72 | Pale | Δ | ○ | ○ | ○ |
| Example 12 | FCM-14 | 10 | 60 | 48 | 1.6 | 77 | Good | ○ | ○ | ○ | ○ |
| Example 13 | FCM-15 | 10 | 55 | 58 | 1.7 | 80 | Good | ◎ | ○ | ○ | ○ |
| Example 14 | FCM-16 | 10 | 50 | 62 | 2 | 80 | Good | ◎ | ○ | ○ | ○ |
| Example 15 | FCM-17 | 10 | 45 | 52 | 2.2 | 69 | Good | ○ | ○ | ○ | ○ |
| Example 16 | FCM-18 | 10 | 40 | 48 | 2.3 | 63 | Good | ○ | ○ | ○ | ○ |
| Example 17 | FCM-19 | 10 | 38 | 46 | 2.5 | 60 | Dark, opaque | Δ | ○ | ○ | ○ |

TABLE 2

| | Toner | Binder resin FP118 (parts by weight) | Change control agent PSY (parts by weight) | Infrared absorbent YKR5010 (parts by weight) | Wax 550P (parts by weight) | Pigment | | Total amount (parts by weight) |
|---|---|---|---|---|---|---|---|---|
| Comparative Example 3 | FCM-20 | 93.5 | 1 | 0.5 | 1 | Rhodamine (C.I. Solvent RED49) 2 parts by weight | C.I. Pigment Violet 19 (γ-type) 2 parts by weight | 4 |
| Comparative Example 4 | FCM-21 | 92.5 | 1 | 0.5 | 1 | Rhodamine (C.I. Solvent RED49) 2.5 parts by weight | Carmine (C.I. Pigment RED57:1) 2.5 parts by weight | 5 |

TABLE 2-continued

| | | | | | | | | |
|---|---|---|---|---|---|---|---|---|
| Comparative Example 5 | FCM-22 | 93.5 | 1 | 0.5 | 1 | Dimethylquinacridone (C.I. Pigment RED122) 1 part by weight | Carmine (C.I. Pigment RED57:1) 3 parts by weight | 4 |
| Comparative Example 6 | FCM-23 | 92.5 | 1 | 0.5 | 1 | Dimethylquinacridone (C.I. Pigment RED122) 2.5 parts by weight | C.I. Pigment Violet 19 (γ-type) 2.5 parts by weight | 5 |
| Comparative Example 7 | FCM-24 | 92.5 | 1 | 0.5 | 1 | Dimethylquinacridone (C.I. Pigment RED122) 2.5 parts by weight | Dichloroquinacridone (C.I. Pigment RED202) 2.5 parts by weight | 5 |
| Example 18 | FCM-25 | 93 | 1 | 0 | 1 | C.I. Pigment Violet 19 (γ-type) 4.5 parts by weight | C.I. Pigment Violet 19 (γ-type) 0.5 parts by weight | 5 |

| | Toner | Color range L* | a* | b* | Chromaticity | Tone | Tone judgment | Ecological properties | Light fastness | Flash resistance |
|---|---|---|---|---|---|---|---|---|---|---|
| Comparative Example 3 | FCM-20 | 45.0 | 35.0 | 12.5 | 58 | Low chromaticity | X | ○ | XX | X |
| Comparative Example 4 | FCM-21 | 44.0 | 36.3 | 14.6 | 59 | Low chromaticity | X | ○ | XX | X |
| Comparative Example 5 | FCM-22 | 44.0 | 32.0 | 3.6 | 55 | Low chromaticity | X | ○ | X | Δ |
| Comparative Example 6 | FCM-23 | 45.0 | 36.0 | 2.3 | 58 | Low chromaticity | X | ○ | ○ | ○ |
| Comparative Example 7 | FCM-24 | 45.0 | 37.5 | 2.6 | 59 | Low chromaticity | X | X | ○ | ○ |
| Example 18 | FCM-25 | 55.0 | 61.0 | 1.8 | 82 | Very good | ◎ | ○ | ○ | ○ (Heat roll) |

C.I. Pigment Violet 19 (γ-type): trade name: RED E2B 70 (Clariant(Japan)K.K.)
C.I. Pigment Violet 19 (β-type): trade name: Redviolet ER02 70 (Clariant(Japan)K.K.)
C.I. Pigment RED 49: trade name Oil Pink 312 (Orient Chemical Industries, Ltd.)
C.I. Pigment RED 57:1: trade name: IRGALITE MAGENTA SMB (Ciba-Geigy Corp.)
C.I. Pigment RED 122: trade name: IRGALITE MAGENTA DMQ (Ciba-Geigy Corp.)
C.I. Pigment RED 202: trade name: Cinquasia Magenta RT-143-D (Ciba Speciality Chemicals Inc.)
FR118: Polyester (Kao Corporation)
PSY: Quaternary ammonium salt (Clariant(Japan)K.K.)
550P: Polypropylene (Sanyo Chemical Industries, Ltd.)
YKR5010: Phthalocyanine compound (Yamamoto Kasei K.K.)

As shown in Tables 1 and 2, all the toners used in Examples are superior in the following characteristics: tone, ecological properties, light fastness and flash resistance. Particularly, Examples 2 to 9 (FCM-3 to 10) have good tone because Pγ/Pβ is in the following range: 25<Pγ/Pβ<50.

Also, it is found from the results of the tones of Examples 12 to 16 (FCM-14 to 18) that the amount of the pigment added to the toner is preferably in a range of 2.2 to 16.5 parts by weight.

Also, good results are obtained in Example 18 in which heat-roll fixing is carried out.

In Comparative Examples 3 to 7 (FCM-20 to 24), on the other hand, any combination of the pigments cannot prevent the pigments from aggregating because no master-batch process is not performed during kneading and therefore good tone is not obtained. In the case of using, particularly, a Rhodamine dye, the color of the print product considerably fades after the print product is allowed to stand outdoors for one month. Also, flash fusing causes violent sublimation and therefore, these comparative toners cannot be used.

Also, when using carmine, a color-off phenomenon is observed though it is weaker than in the case of using Rhodamine. In the case of a combination of C.I. Pigment Violet 19 and C.I. Pigment Red 122 which is a quinacridone, less transparency is obtained because no master-batch process is carried out and remarkably dark printing is obtained though outdoor preserving stability and flash sublimation characteristics are good.

What is claimed is:

1. A toner for developing an electrostatic latent image, comprising toner particles, said toner particles comprising a binder resin and only one pigment, wherein the only one pigment is a quinacridone pigment having a β-type crystal structure represented by the following structural formula and a quinacridone having a γ-type crystal structure represented by the following structural formula

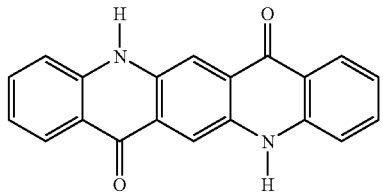

;

and wherein the toner has L* of not less than 45, a* of not less than 40, b* of from −20 to 20 in a CIELAB color space, wherein said L*a*b* is detected by an image formed with the toner on a surface of a recording material with an amount of 0.5 mg/cm$^2$.

2. The toner according to claim 1, wherein a ratio of the quinacridone having the β-type crystal structure to the quinacridone having the γ-type crystal structure in the quinacridone pigment satisfies the following relation (1):

$$0.25<P\gamma/P\beta<50 \quad (1)$$

wherein Pβ represents parts by weight of the quinacridone having the β-type crystal structure based on 100 parts by weight of the toner particles, and Pγ represents parts by weight of the quinacridone having the γ-type crystal structure based on 100 parts by weight of the toner particles.

3. The toner according to claim 1, wherein the only one quinacridone pigment is contained in the toner in an amount of 2 to 15 parts by weight based on 100 parts by weight of the toner particles.

4. The toner according to claim 1, wherein the binder resin comprises a polyester.

5. The toner according to claim 1, wherein the binder resin has a glass transition temperature (Tg) in a range of 50 to 70° C.

6. The toner according to claim 1, further comprising an infrared absorbent.

7. The toner according to claim 6, wherein the infrared absorbent is contained in the toner in an amount of 0.01 to 5 parts by weight based on 100 parts by weight of the toner particles.

* * * * *